US005980401A

United States Patent [19]

Erlewine

[11] Patent Number: 5,980,401

[45] Date of Patent: Nov. 9, 1999

[54] BACKBOARD AND RIM KIT FOR WALL MOUNTING

[75] Inventor: Mark R. Erlewine, Marion, Ind.

[73] Assignee: Warner Bros. Consumer Products, Burbank, Calif.

[21] Appl. No.: 08/979,229

[22] Filed: Nov. 26, 1997

Related U.S. Application Data

[60] Provisional application No. 60/031,856, Nov. 27, 1996.

[51] Int. Cl.[6] ..... A63B 63/08

[52] U.S. Cl. ..... 473/481

[58] Field of Search ..... 473/447, 472, 473/479, 481, 485, 487, 480, 488; 273/398, 400, 401, 402

[56] References Cited

U.S. PATENT DOCUMENTS

| | | | |
|---|---|---|---|
| 2,517,463 | 8/1950 | Cobb | 473/481 |
| 4,826,712 | 5/1989 | Theno | 428/4 |
| 4,926,060 | 5/1990 | Sittig | 273/400 |
| 5,064,195 | 11/1991 | McMahan et al. | 473/480 |
| 5,098,108 | 3/1992 | McKinney | 473/487 X |
| 5,192,612 | 3/1993 | Otter et al. | 428/355 |
| 5,196,246 | 3/1993 | Kauss et al. | 428/39 |
| 5,290,067 | 3/1994 | Langen | 283/60.1 |
| 5,403,000 | 4/1995 | Woosley | 473/485 X |

*Primary Examiner*—William H. Grieb
*Attorney, Agent, or Firm*—James Creighton Wray; Meera P. Narasimhan

[57] ABSTRACT

The invention provides a backboard which is mountable on any wall surface, and which may be readily removed from the wall surface without leaving a mark or disfiguring the surface. The backboard is made of a thin, flexible sheet of material with a rear surface which firmly attaches to a wall, is held against the wall and is removable from the wall without marking the wall. A basketball rim and support is mounted on a lower position on the backboard material by a double-stick foam tape. One side of the foam tape adheres to the backboard in a pre-marked space. A vertical member of a support is attached to the other face of the foam tape, and a horizontal hoop is cantilevered from the support. A fabric net hangs down from the hoop to slow the descent of a ball which is used with the backboard. The net may be formed of lightweight flexible plastic filaments. The plastic rim and support may be molded of a high strength, light-weight reinforced plastic material. The double-stick foam tape is of a type used permanently to adhere trim signs on automobiles. The backboard is made of a flexible rollable plastic sheet material which is capable of self-sustaining on a wall, and which may be held against a wall through repeated usage over long periods of time, and which may be peeled from a wall, leaving no marks.

27 Claims, 1 Drawing Sheet

BACKBOARD AND RIM KIT FOR WALL MOUNTING

This application claims the benefit of U.S. Provisional Application Ser. No. 60/031,856 filed Nov. 27, 1996.

BACKGROUND OF THE INVENTION

It is popular to use lightweight, soft foam plastic balls to shoot baskets in an interior of a house. Basketball backboard are often hung on hooks which extend over the tops of doors so that the backboard hangs down along the door. A rim and mount are fixed to the backboard, such as by screws.

Such a backboard and rim cannot be mounted anywhere in the room, and mounting of the backboard may cause disfigurement of the finish on the door, and the hooks may show on the other side of the door.

Needs exist for better backboard, hoops and mounts which may be mounted anywhere within a room.

SUMMARY OF THE INVENTION

The present invention provides a backboard which is mountable on any interior wall surface, and which may be readily removed from the wall surface without leaving a mark or disfiguring the surface. The backboard is made of a thin, flexible sheet of material with a rear surface which firmly attaches to a wall, is held against the wall and is removable from the wall without marking the wall. A basketball rim and support is mounted on a lower position on the backboard material by a double-stick foam tape. One side of the foam tape adheres to the backboard in a pre-marked space. A vertical member of the support is attached to the other face of the foam tape, and a horizontal hoop is cantilevered from the support. A fabric net hangs down from the hoop to slow the descent of a ball which is used with the backboard.

The net may be formed of lightweight flexible plastic filaments. The plastic rim and support may be molded of a high strength, lightweight reinforced plastic material. The double-stick foam tape is of a type used permanently to adhere trim signs on automobiles. The backboard is made of a flexible rollable plastic sheet material which is capable of self-sustaining on a wall, and which may be held against a wall through repeated usage over long periods of time, and which may be peeled from a wall, leaving no marks.

These and further and other objects and features of the invention are apparent in the disclosure, which includes the above and ongoing written specification, along with the claims and the drawings.

DETAILED DESCRIPTION OF THE PREFERRED EMBODIMENT

Figure 1:
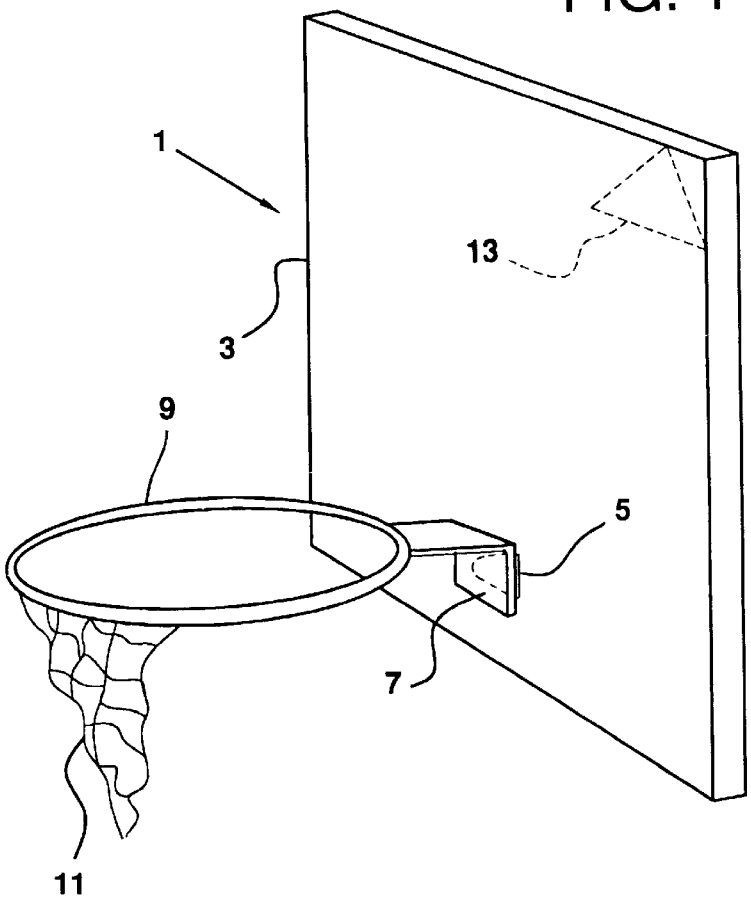
FIG. 1 is a perspective view of a toy basketball backboard and basket rim, netting and mount.
Figure 1:
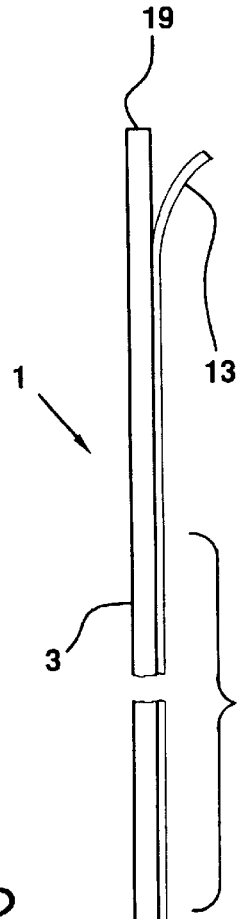

Referring to FIG. 1, a basketball basket and backboard for mounting the basket rim inside a room is generally indicated by the numeral 1. A thin, flexible backboard 3 adheres to an inner wall of a room. Standard backboard graphics, for example a square above the basketball mount, may be printed on the backboard. Additional backboard outlines may also be printed on the backboard. Graphics of popular players and teams may be printed on the wall-mounted backboard.

The backboard is preferably made of a material, such as a material sold under the trademark EXSTATIC. The material is sold in a roll of material. A backing material, which keeps the wall side of the sheet clean, is removed before the material is pressed against a wall. The material may be peeled from the wall by starting from an upper corner. Peeling the material from the wall leaves no mark on the wall.

A double-sided foam tape of the type used for mounting automobile trim is mounted within a pre-screened area on the backboard 1. A release coating is peeled from the double-stick foam tape 5, and a mount 7 is stuck to the second side of the foam tape.

The mount 7 has a round hoop or rim 9 formed with the mount, and a fabric net 11 is hung from the rim. The result is a basket and backboard which is mounted directly on a wall and which can be peeled off a wall without leaving any mark. The adhesive foam tape may be packaged with the rim and backboard as a third piece. Alternatively, one side of the double adhesive foam tape may be pre-mounted on the rim mount or on the backboard.

Figure 2:
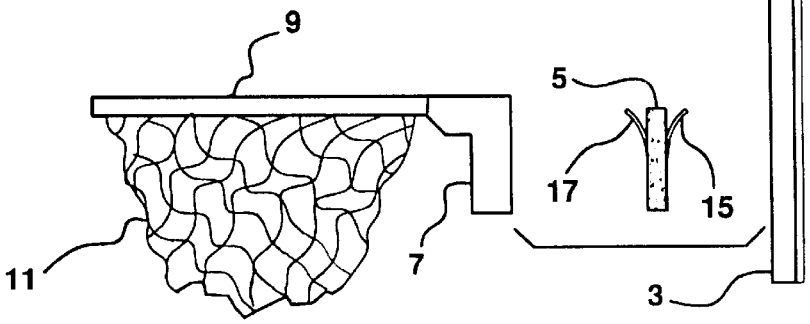
FIG. 2 is an exploded side elevational view of the backboard, rim and mount.

As shown in FIG. 2, a backer sheet 13 is pulled from the rearward face of the flexible backboard sheet 3, readying the backboard sheet 3 for sticking in position on the painted or wallpapered surface of an interior wall.

A first release strip 15 is pulled from one side of a pre-cut double-stick foam tape 5, and the foam tape is stuck to the backboard 3 within a pre-printed square on the backboard. The second release layer 17 is peeled from the front of the double-stick foam tape 5, and the vertical rear wall of the mount 7 is pressed against the double-stick foam tape. That adheres the mount 7 and the rim 9 to the double-stick foam tape 5 and to the backboard 3. A net 11 slows the descent of a ball.

The backboard, hoop and net structure 1 is mounted on any wall and can be moved from the wall by simply peeling the flexible backboard 3 from the wall. The double-stick foam tape 5 tightly adheres the mount 7 and the rim 9 to the backboard 3. Because it is positioned well below the upper edge 19 of the flexible backboard material 3, downward forces on the hoop 9 do not pull the backboard assembly away from the wall on which it is stuck. No mark is left on the wall.

Preferably, the backboard is a thin sheet which is covered by an adhesive which clings to the sheets and peels from the wall without leaving a trace on the wall. Other backboards may be employed. For example, a foldable sheet or a sheet held by static electricity may be used. However, a weak adhesive-coated rollable sheet with a removable backing sheet is preferred.

While the invention has been described with reference to specific embodiments, modifications and variations of the invention may be constructed without departing from the scope of the invention, which is defined in the following claims.

I claim:

1. A basketball backboard kit comprising a removably mountable backboard for mounting on mounting surfaces and for readily removing from the surfaces without marking or disfiguring the surfaces, wherein the backboard is of a flexible rollable self-sustaining plastic sheet material.

2. The backboard kit of claim 1, wherein the backboard is a thin, flexible sheet of material.

3. The backboard kit of claim 1, wherein the backboard has front and rear surfaces, and wherein the rear surface is firmly and removably attachable to the mounting surfaces.

4. The backboard kit of claim 1, further comprising a basketball rim and support mounted on the backboard.

5. The backboard kit of claim 4, wherein the rim and support are mounted proximal a lower portion of the backboard in a premarked space.

6. The backboard kit of claim 1, wherein the backboard is removable and reusable for repeated usage over long periods of time at differing locales, and further comprising an adhesive rear surface of the backboard, wherein the backboard is peelable from a mounting surface without leaving any marks.

7. A basketball backboard kit comprising a removable mountable backboard for mounting on surfaces and for readily removing from the surfaces without marking or disfiguring the surfaces, further comprising a basketball rim and support mounted on the backboard, further comprising a double-stick foam tape having opposing sides, wherein one side of the foam tape removable connects to the backboard.

8. The backboard kit of claim 7, further comprising a vertical member on the rim and support for removably connecting to another side of the foam tape, and horizontal hoop cantilevered from the support.

9. The backboard kit of claim 8, further comprising a net suspended from the hoop.

10. The backboard of claim 9, further comprising a ball for inserting in the hoop, and wherein the net is a fabric net for slowing descent of the ball inserted in the hoop.

11. The backboard kit of claim 9, wherein the net is of lightweight flexible plastic filaments.

12. The backboard kit of claim 7, wherein the rim and support are of molded high strength, lightweight reinforced plastic material.

13. The backboard kit of claim 7, wherein the double-stick foam tape is permanently adherent to the backboard.

14. A wall-mountable apparatus comprising a backboard for mounting on wall surfaces and for readily removing from the surfaces without marking or disfiguring the surfaces, and a support mounted on the backboard, and a rim connected to the support, wherein the backboard is of a flexible rollable self-sustaining plastic sheet material.

15. The apparatus of claim 14, wherein the backboard is a thin, flexible sheet of material.

16. The apparatus of claim 14, wherein the backboard has front and rear surfaces, and wherein the rear surface is firmly and removably attachable to the wall.

17. The apparatus of claim 14, wherein the rim and the support are mounted on the backboard.

18. The apparatus of claim 17, wherein the support and the rim are mounted proximal a lower portion of the backboard in a premarked space.

19. The apparatus of claim 14, wherein the rim and the support are of molded high strength, lightweight reinforced plastic material.

20. The apparatus of claim 14, wherein the backboard is removable and reusable for repeated usage over long periods of time at differing locales, and further comprising an adhesive rear surface of the backboard, wherein the backboard is peelable from a mounting surface without leaving any marks.

21. A wall-mountable apparatus comprising a backboard for mounting on wall surfaces and for readily removing from the surfaces without marking or disfiguring the surfaces, and a support mounted on the backboard, and a rim connected to the support, further comprising a double-stick foam tape having opposing sides, wherein one side of the foam tape is connected to the backboard.

22. The apparatus of claim 21, further comprising a vertical member on the support for removably connecting to another side of the foam tape, and a horizontal hoop cantilevered from the support.

23. The apparatus of claim 22, further comprising a ball for inserting in the hoop.

24. The apparatus of claim 22, further comprising a net suspended from the hoop.

25. The apparatus of claim 24, wherein the net is a fabric net for slowing descent of the ball inserted in the hoop.

26. The apparatus of claim 24, wherein the net is of lightweight flexible plastic filaments.

27. The apparatus of claim 21, wherein the double-stick foam tape is permanently adhered to the backboard.

* * * * *